US005456650A

United States Patent [19]

Williams, Jr. et al.

[11] Patent Number: 5,456,650

[45] Date of Patent: Oct. 10, 1995

[54] ERGONOMIC EXERCISING AND BRACING DEVICE

[75] Inventors: Charlton H. Williams, Jr.; Larry G. Nelson, both of Marietta, Ga.

[73] Assignee: Natraflex Systems, Inc., Seale, Ala.

[21] Appl. No.: 151,728

[22] Filed: Nov. 12, 1993

Related U.S. Application Data

[63] Continuation-in-part of Ser. No. 923,044, Jul. 31, 1992, Pat. No. 5,453,064.

[51] Int. Cl.[6] ..... A63B 23/16

[52] U.S. Cl. ..... 482/47; 482/49; 482/124; 273/189 A; 2/161.2

[58] Field of Search ..... 2/255, 256, 161.1, 2/161.2, 161.4, 161.6, 162, 166; 482/47, 49, 124; 602/21, 22; 273/188 R, 189 A, 189 R; D2/616, 617, 620; D21/198; 601/40; 128/878, 879; 473/61

[56] References Cited

U.S. PATENT DOCUMENTS

| | | | |
|---|---|---|---|
| 272,951 | 2/1883 | Gardner . | |
| 425,887 | 4/1890 | Kohler . | |
| 494,197 | 3/1893 | Hall . | |
| 867,981 | 10/1907 | Krizek . | |
| 1,471,948 | 10/1923 | Cox . | |
| 1,728,679 | 9/1929 | Hansard | 273/189 R |
| 1,797,057 | 3/1931 | Foulke . | |
| 2,025,357 | 12/1935 | Pagan . | |
| 2,108,236 | 2/1938 | Scott . | |
| 2,154,197 | 4/1939 | Callaway . | |
| 2,369,115 | 2/1945 | Bloom . | |
| 2,695,999 | 12/1954 | Arnold . | |
| 2,794,638 | 6/1957 | Risher . | |
| 3,031,680 | 5/1962 | Compiano . | |
| 3,164,841 | 1/1965 | Burtoff . | |
| 3,229,306 | 1/1966 | Bazar | 473/61 |
| 3,344,436 | 10/1967 | Stubbs . | |
| 3,347,547 | 10/1967 | Hynes . | |
| 3,408,077 | 10/1968 | Norwood | 273/189 A |
| 3,533,405 | 10/1970 | Collins . | |
| 3,581,312 | 6/1971 | Nickels . | |
| 3,588,917 | 6/1971 | Antonious . | |
| 3,606,614 | 9/1971 | Dimitroff . | |
| 3,643,386 | 2/1972 | Grzyll . | |
| 3,890,649 | 6/1975 | Diggins . | |
| 3,944,220 | 3/1976 | Fasano . | |
| 4,138,108 | 2/1979 | Robinson | 273/189 A |
| 4,309,991 | 1/1982 | DeMarco . | |
| 4,330,120 | 5/1982 | Netti . | |
| 4,400,831 | 8/1983 | Rietz . | |
| 4,438,532 | 3/1984 | Campanella . | |
| 4,502,688 | 3/1985 | Papp . | |
| 4,525,877 | 7/1985 | Chong . | |
| 4,546,495 | 10/1985 | Castillo . | |
| 4,584,309 | 8/1986 | Elsey . | |
| 4,658,445 | 4/1987 | Tribble | 273/189 R |
| 4,701,963 | 10/1987 | Overton . | |
| 4,716,892 | 1/1988 | Brunswick | 602/21 |
| 4,829,604 | 5/1989 | Allen . | |
| 4,830,360 | 5/1989 | Carr . | |
| 4,843,651 | 7/1989 | Gramza . | |
| 4,863,159 | 9/1989 | Brown . | |
| 4,905,321 | 3/1990 | Walunga . | |
| 4,919,966 | 4/1990 | Shlenker . | |
| 5,019,096 | 5/1991 | Fox . | |
| 5,033,119 | 7/1991 | Wiggins . | |
| 5,113,526 | 5/1992 | Wang et al. | 2/161.6 |
| 5,113,849 | 5/1992 | Kuiken . | |
| 5,135,217 | 8/1992 | Swain . | |
| 5,156,168 | 10/1992 | Canterna . | |
| 5,170,508 | 12/1992 | Kawada | 2/161.4 |
| 5,172,910 | 12/1992 | Ashurst | 473/61 |
| 5,295,948 | 3/1994 | Gray | 602/21 |

FOREIGN PATENT DOCUMENTS

| | | | |
|---|---|---|---|
| 48487 | 10/1917 | France | 482/47 |

*Primary Examiner*—Richard J. Apley
*Assistant Examiner*—Jeanne M. Clark

[57] ABSTRACT

A device for exercising the fingers, hands, and forearms of a user while bracing the wrist of the user. The device incorporates flexible, resilient rods made of a material such as a composite. The rods are configured to extend from a tip of the finger to at least base of the finger. A brace is provided which extends across the back of the hand and across the back of the wrist of the user.

19 Claims, 2 Drawing Sheets

ERGONOMIC EXERCISING AND BRACING DEVICE

RFERENCE TO RELATED APPLICATION

This is a continuation-in-part of Ser. No. 07/923,044, filed Jul. 31, 1992 now U.S. Pat. No. 5,453,064.

FIELD OF THE INVENTION

This invention relates in general to exercise fitness equipment, and more specifically relates to the use of rods in a glove to offer resistance to individual fingers for the purpose of exercising those fingers and the use of a brace for holding the wrist in place such that the user of the glove may develop his or her forearm and hand muscles with the rods while the wrist is located in the proper position.

BACKGROUND OF THE INVENTION

In every dynamic sport, motion combined with resistance produces power. For example, in tennis, the server winds up his upper body as his lower body resists and then the player whips the racket through impact. The wound up, stored up energy is released through the shoulders and into the racket by the connection of the shoulders to the end of the racket.

The same is true of other racket sports as well as club and bat sports. In each of these sports, a large amount of resistance and motion is generated throughout the body which in turn is transferred to the racket, club, or bat. To optimize the larger, stronger muscles of the body, a proper kinetic link must be maintained between the motion generated by those muscles and the racket, club, or bat. Generally, the player's only contact with the racket, club, or bat is the hand or hands of the user.

A perfect example of this principal can be witnessed in a golf swing. The golfer contacts a club with both of his hands at one end of the shaft. Then, in a long, continuous motion, the golfer develops a series of resisting forces working against each other to build up a tensioning at the top of the swing. This tensioning is then released, and together with the fluid motion of the golfer's body, this release of tension generates the club head speed which is imparted to the ball.

In a golf swing, the golfer begins with his club at a stationary position behind the ball, and through a series of motions brings that club head back and then forward again to impact the ball and swing through the ball. Where the club head faces at impact will determine the flight of the ball and the spin put on that ball. If the club faces squarely to its path of movement at impact, the ball will not only take off on that path but will also continue straight in that direction, given on-center contact without any influence of wind. If the club head is facing to the left of its path, the ball will curve to the left of that directional path. If it faces to the right of this path, the ball will curve to the right. Thus, to maintain consistency in shots, it is imperative that a golfer consistently return his club head to the ball so that the club face is in the desired orientation. This desired orientation is generally the orientation the club head has before the beginning of the swing. The problem with returning the club head to this proper position is the body undergoes a large amount of movement during the swing.

To maximize club head speed as well as consistency, it is necessary to do what golfers call "swing through the ball". This simply means that the club head must be brought up and back along a swing path and returned along that path.

During this movement, the club head face does not remain square with the target, but instead resembles the movement of an opening and closing door. Thus, at the beginning portions of the swing of a right-hander, the club head face points more and more to the right of the target. Once the club head reaches the top of the swing, it begins back down and closes this angle back to square at impact. On the follow-through, or portion after impact with the ball, the club head faces more and more left of the target. To effectively perform this movement, all that is required is a swinging of the club about a pivot point. Any twisting or unnatural contortions of the wrists or body during the swing could cause the club head to return along the wrong swing path or could cause the club face not to return to the ball in a squared fashion.

Generating the maximum club head speed while swinging through the ball requires the pivot point be as far away from the club head as is physically possible. In the golf swing, that means the pivot point is the left shoulder. By creating the pivot at the left shoulder, the golfer creates an arc upon which the club head must travel which includes the length of the left arm as well as the length of the club. By moving the left arm and the club together as a unit, the club head may travel along this arc and generate its maximum speed at the bottom of the swing. However, maintaining a straight line with the left ann and the club throughout the backswing causes the swing to be stiff and uncomfortable, and limits the amount the golfer can bring the club head back. This problem is resolved by having the wrists break (called a "wrist cock") during the backswing and return to the original position by impact. Additional club head speed is generated by having the wrist cock at the top of the swing by creating a second pivot point at the hands or end. of the club such that the club head may generate speed from the action of the wrists. The wrist cock also makes the swing a more fluid motion.

The problem with the use of these two pivot points is that a player must start from the position shown in FIG. 1, where the club shaft and the left arm form a straight line, and move to the position in FIG. 2, where the club head and the left arm form basically an acute angle, and back to a position as is shown in FIG. 3 where the left arm and club form a straight line once again.

To properly perform a wrist cock, the wrist must move along certain planes. In describing movement of the wrists, the following terms will be used: extension, flexion, abduction, and adduction. Flexion and extension are caused by pivoting the hand about a transverse axis of the wrist which lies parallel to the back of the wrist; flexion being the movement of the palm forward toward the forearm, extension being the movement of the back of the hand toward the forearm. If a plane is defined parallel to the transverse axis and parallel to the back of the hand, abduction and adduction are the movement of the hand back and forth in that plane; abduction being the movement of the hand toward the little finger, and adduction being the movement of the hand toward the thumb.

Most amateurs have a breakdown somewhere in their swing and do not return to the position shown in FIG. 3 at impact. A common mistake among right-handed amateurs is allowing the stronger right hand to take over in the swing and force the left hand to collapse into an extension or flexion. As a golfer first begins playing, this is the relaxed and easiest form of the swing. However, by allowing the left hand to collapse, the kinetic link between the left shoulder and the club head is broken and the full radial arc between the shoulder and the club head is not maintained. The club therefore impacts the ball in an orientation other than the optimal, and a slice, hook, duff, or other unwanted result occurs.

To correctly get into the position of FIG. 3, a golfer must have the back of his left hand substantially parallel to and substantially in the same plane as the back of his wrist. This means that if any extension or flexion of the left wrist occurs when the golfer moves from the position in FIG. 1 to the position in FIG. 2, that flexion or extension must be reversed such that the wrist and hand are back into the planar position as is shown in FIG. 3. To accurately time any such reversal on a consistent basis is difficult, if not impossible, to do.

To avoid extension or flexion of the wrists, it is preferred that right-handed golfers maintain the back of their left hand in a planar position with the back of the left wrist during the entire swing. The wrist cock is therefore performed by adduction and abduction of the left wrist.

Holding the wrists in this proper position takes strength. However, for most amateurs the flexors (the muscles of the forearm which are contracted when the hand extends into flexion) and the extensors (the muscles of the forearm which are contracted when the wrist extends into extension) are not properly developed; therefore, the golfer is unable to hold the wrist properly in position throughout the swing. Deadlocking the wrist to the club is not enough. A proper swing requires that the grip be loose, but firm, and that the wrist be capable of adduction and abduction. The muscles of the lower arm must be strong enough to prevent the wrist from moving into flexion or extension during the swing, yet relaxed enough when holding this position to allow for a loose grip so that free swinging of the club may occur.

An additional problem amateur golfers encounter is developing the proper angle between the forearms and the club. As viewed in FIG. 1, the left forearm and the club form a straight line. However, when that view is from behind the golfer, or from the left in FIG. 1, the forearm and club form an obtuse angle. This juncture is not straight because it is nearly impossible to grip a club and bend the wrist to align with the shaft. Instead, in the natural grip, the hands extend downward from the shoulders and grip the club, which extends outward to the ball. Several studies indicate the proper angle between a line extending from the club underneath the left forearm and a line extending parallel to the forearm should be about 19°. This, the obtuse angle formed between the left forearm and the club would be approximately 161°. This angle has been found to be the most ergonomically correct angle, in that it is the most comfortable and therefore promotes correct return to the same position. Amateur golfers often extend the club too far away from the body, or hold it too close to the body, making the angle more or less than this ergonomic optimum. Therefore, the golfer finds it more difficult to return his club along the swing path because he is working against the natural movement of his wrists.

There is a need in the art for a device which develops proper muscle, tendon, and nerve memory for a golfer to position his hands correctly throughout a swing and which additionally gives exercise to the forearm muscles so that the golfer may hold the club in that position when removing the device. There is also a need for a device which promotes proper positioning of the hands relative to a golf club.

SUMMARY OF THE INVENTION

The present invention solves the above-mentioned problems by introducing a dual bracing and exercising system in a glove. The device allows adduction and abductions while holding the left wrist flat relative to the back of the hand. The device helps resist any temptation a golfer may have to extend or flex the left wrist. The results are straighter, longer, more accurate shots including drives, fairway shots, approach shots, and putts. The device might also be used in other racket, club, and bat sports so that proper wrist positioning may be achieved.

More specifically described, the present invention provides a device for exercising and bracing the hand of a user. The device includes a support and a flexible, resilient rod having a resistance to bending and operatively associated with the support. The rod is configured to extend approximately from a tip of the finger of the user to at least the base of the finger. The device also includes means for maintaining the rod in operative association with a finger of the user such that the resilience and resistance to bending of the rod causes the hand to be exercised when the user attempts to close the hand or to maintain the hand in a closed or partially closed position. The device further provides a brace operatively associated with the support, the brace configured to extend at least partly across the back of the hand of the user and at least partly across the back of the wrist of the user. A means for holding the brace is provided which firmly holds the brace against the back of the hand and back of the wrist of the user such that the extension or flexion of the wrist is resisted while permitting adduction and abduction.

Preferably, the support member is configured such that the rod extends at an acute angle from a line defined by the longitudinal axis of the forearm of the user when the device is placed on the user. This angle is preferably approximately 19°. For best results, two rods are provided, one for extending up the middle finger of the user and the other for extending up the ring finger of the user. The device may also be incorporated into a glove. To add additional exercising benefits, the device may be formed into a configuration so as to bias the hand of the user into extension or flexion.

Therefore, it is an object of the present invention to provide an improved exercising device for the lower ann muscles of a user.

It is a further object of the present invention to provide an exercising device for the lower arm muscles which is of variable resistance.

Another object of the present invention is to provide an exercising device for the lower arm muscles which does not rely on gravity.

Yet another object of the present invention is to provide a dual bracing and exercising system for the fingers, hand, wrist, and forearm which teaches proper muscle, tendon, and nerve memory for the fingers, hands, wrists, and forearms during a swing of a club, bat, or racket.

A further object of the present invention is to provide a dual bracing and exercising system which exercises the flexors and extensors of a wrist while the user is participating in a racket, club, or bat sport.

Still another object of the present invention is to train a user to develop the proper angle between the user's forearm and a club, racket, or bat.

Other objects, features, and advantages will become apparent upon consideration of the following detailed description of the invention, when taken in conjunction with the drawing and the appended claims.

DESCRIPTION OF THE PREFERRED EMBODIMENT

Figures 1, 2, 3:
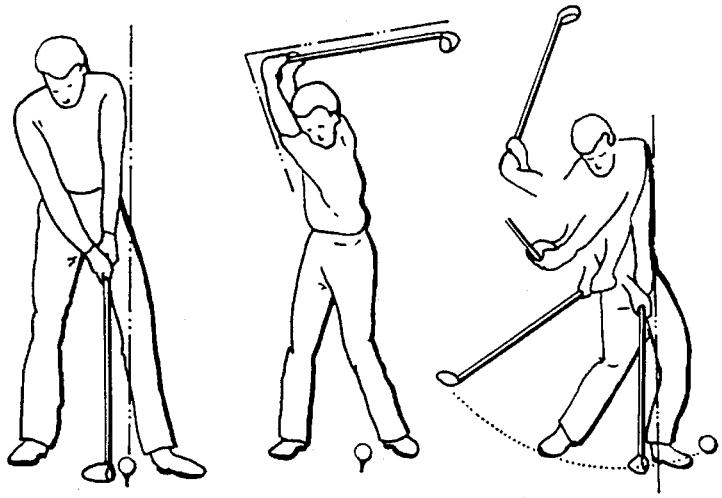
FIG. 1 is a front view of a golfer properly addressing a ball.
FIG. 2 is a front view of the golfer of FIG. 1 with the club at the top of the swing.
FIG. 3 is a front view of the golfer of FIGS. 1 and 2 with the club at the bottom portion of its swing.
Figure 4:
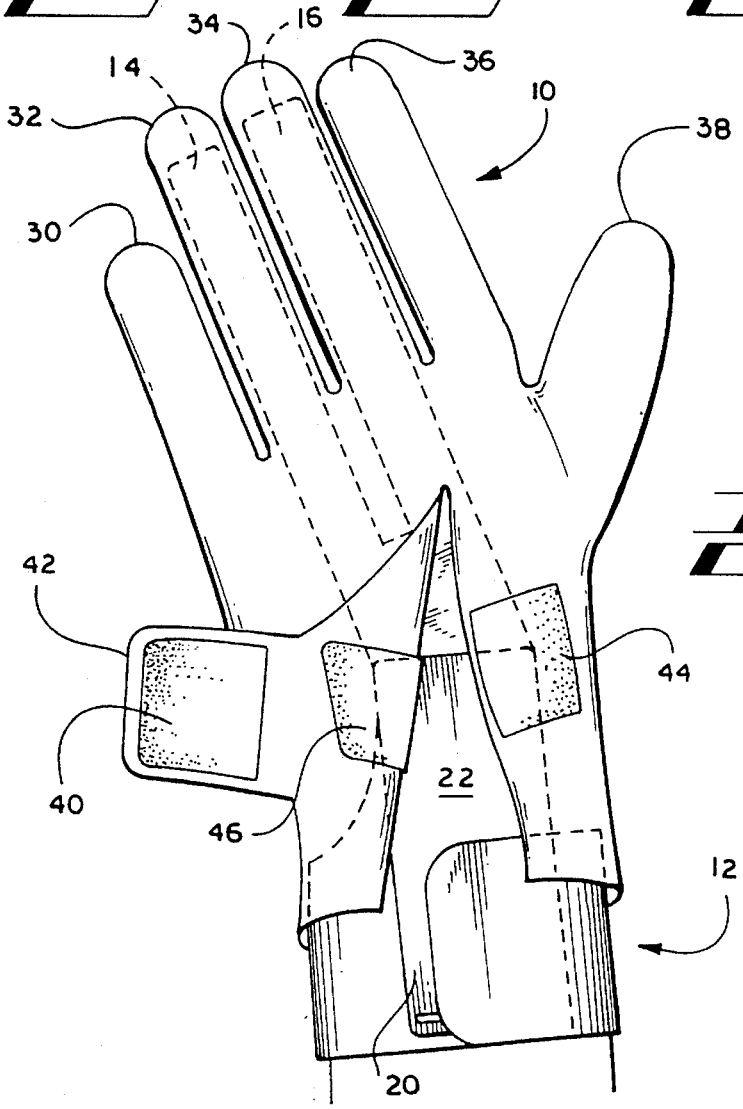
FIG. 4 is a pictorial view of a device embodying the present invention, the device inserted into a glove and placed on the hand of a user.

Referring now to the drawing, in which like reference numerals represent like parts throughout the several views, FIG. 4 discloses a glove 10 shown on a left hand of a user and incorporating a combined exercising and bracing device 12 embodying the present invention. The device 12 is shown removed from the glove 10 and the user in FIG. 5.

Figures 5, 6:
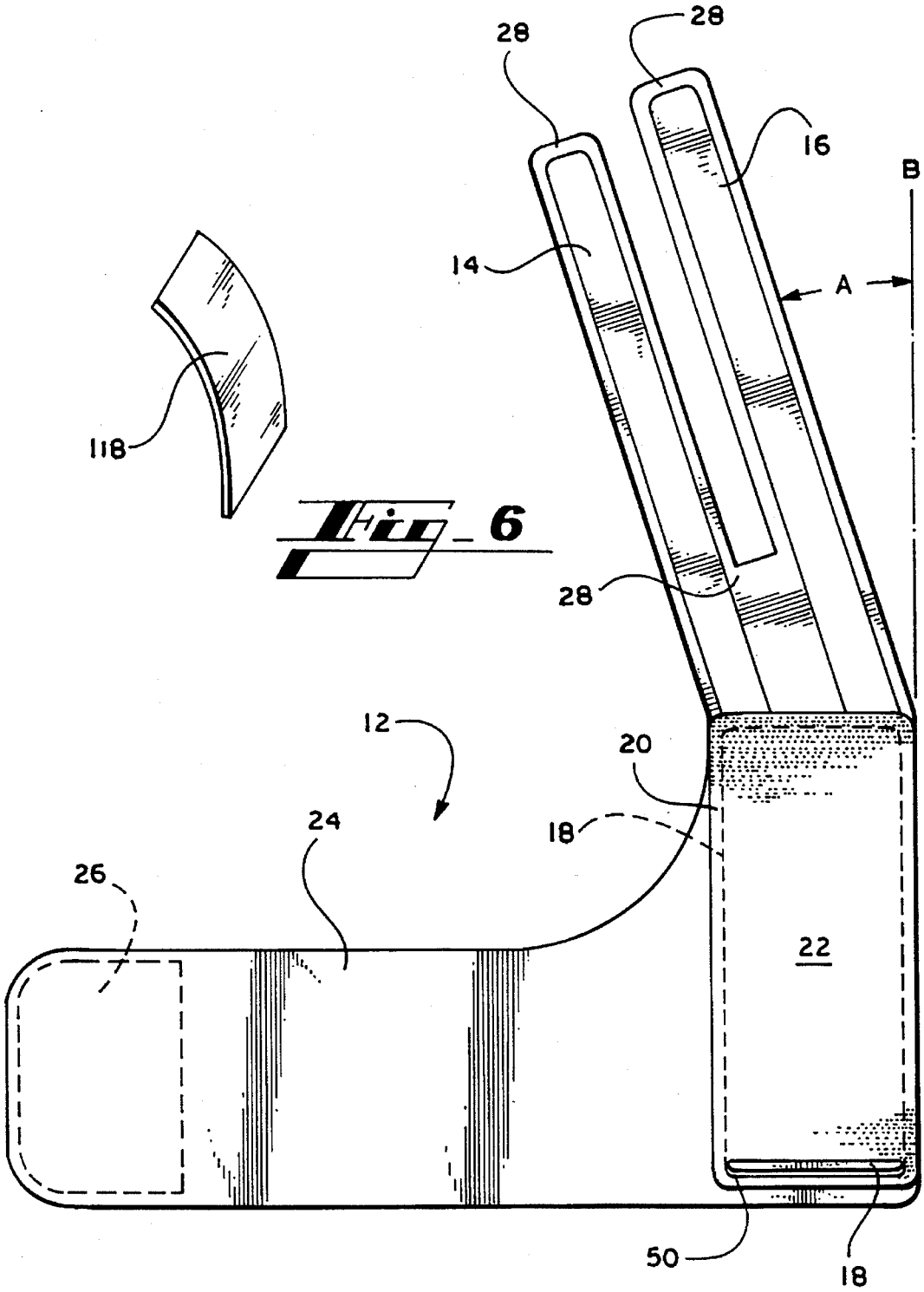
FIG. 5 is a front view of the device of FIG. 4 with the device removed from the hand of the user.
FIG. 6 is an alternative brace to be used with the device of FIG. 5.

As is shown in FIG. 5, the device 12 of the present invention preferably includes rods 14, 16 configured to extend approximately from the tip of the finger down to a part on the back of the hand, preferably to the juncture of the wrist and hand. In addition, the device 12 includes a wrist stabilizing brace 18 which is contained in an insert holder 20. The insert holder 20 includes male hook fabric 22, of the conventional hook and loop variety, extending along its length. The insert holder 20 is sewn in place on a wrist wrap 24 which includes female loop fabric 26 along the back, end portion of the wrap. The loop fabric 26 is adapted to engage the hook fabric 22, as is explained below.

The wrist wrap 24 preferably has outer layers of a substantially inextensible fabric and an inner foam layer. Alternatively, an extensible material may be used for greater comfort and less of a bracing effect, as is described below. The wrap 24 includes an extension 28 which extends up the length of the rods 14, 16, as is shown in FIG. 5. The wrist wrap 24 and the extension 28 form a support for holding the rods 14, 16 and the brace 18 in place. Any system may be used to form the support as long as the support orients the brace 18 and the rods 14, 16 in their respective positions relative to the hand. If wanted, the rods 14, 16 may be inserted within the foam, between the fabric and foam layers, or even in pockets in the fabric to hold the rods in place. Otherwise, the rods 14, 16 may be glued or attached to the outside of the extension 28 in a suitable manner. As can be seen in the drawing, the rods 14, 16 extend at an angle A from a line B which extends parallel to a longitudinal axis of the wrist brace. This longitudinal axis of the wrist brace corresponds to a line which extends substantially parallel to the forearm of the user. Preferably, this angle A is approximately 19°, the significance of which is discussed below.

The design of the device 12 is such that it can be inserted into a standard golf glove. Such a golf glove 10 is shown in FIG. 4. The glove in FIG. 4 includes finger stalls 30, 32, 34, and 36, and a thumb stall 38. The glove 10 has a conventional closure including a male hook fabric 40 on a tab 42 for engaging female loop fabric 44 on the glove. The glove 10 shown in the drawing has an additional loop fabric piece 46 added along the inside of the glove near the back of the hand.

To install the device 12 and glove 10 on the hand, the glove is first placed on the hand with the hook and loop closures 40, 44 unattached. The device 12 is then inserted, rods 14, 16 first, up the ring and middle finger stalls 32, 34 until the rods are adjacent to the end of the stalls. The wrist wrap 24 is then extended around the wrist of the user and the hook fabric 26 is attached to the loop fabric 22 on the insert holder 20. The glove 10 may then be closed about the hand of the user and the device 12. Preferably, the bottom end of the glove 10 extends around the wrist wrap 24 so that the device 12 and the glove 10 may work together as a unit. As can be appreciated by FIG. 4, the loop fabric 46 provided on the inside of the glove 10 mates with the upper portion of the hook fabric 22 on the insert holder 20 for holding the back of the glove in place. An alternative method of installing the device 12 is to place the device 12 within the glove 10 and then place both the device and the glove on the hand. The user may find this method easier, especially if the glove 10 fits snugly on the hand.

The rods 14, 16 may be formed of any flexible, resilient material having a resistance to bending, but are preferably formed from a hardenable mixture of filaments or fibers saturated in a resin system. However, the rods 14, 16 may be made of any other resilient, flexible material with a suitable toughness to give a useful flexural fatigue life. To the extent the rods are resilient, the rods am bendable, upon the application of a force, but have an ability and bias to immediately return to their initial orientation upon release of that force. Preferably, the rods are formed from 60% Owens-Corning S2-Glass® with a matrix material of 40% polyurethane.

The rods 14, 16 are configured such that when the device 12 is installed on the hand of a user, the rods 14, 16 extend from the fingertips down the length of the fingers. Preferably, the rods extend a little further down to the general vicinity of the back of the hand and even further to the juncture of the wrist and the hand. These rods 14, 16 are best held in place at the back of the hand by running them behind the wrist stabilizer brace 18. The exercising benefits of these rods 14, 16 are explained in detail in the related application, Ser. No. 07/923,044, filed Jul. 31, 1992.

The brace 18 may be made of the same material as the rods 14, 16, but preferably has a greater resistance to bending than these rods. In fact, the applicants have found that the maximum benefits are achieved from using a very stiff brace 18 which has little or no flexibility. Thus, any stiff material may be used for the brace 18, including but not limited to wood, hardened plastic, steel, or composites.

As designed, the device is to be worn while a golfer is swinging a club. The wrist stabilizing brace 18 and the rods 14 and 16 work together to create muscle memory so that proper wrist movements occur in a golf swing, while developing the forearm muscles so that these movements may be repeated when the device 10 is removed. The brace 18 provides stability and resists breaking of the kinetic link between the club head and the major muscle groups of the upper torso. It resists extension as well as flexion of the wrist. The brace 18 serves as a "sensory biofeedback reminder" to better help the body feel what it needs to do during a swing. If the brace 18 includes a somewhat flexible material, the wrist may still extend into extension and flexion, but there is a resistance to such movement. Because it takes an effort to put the wrist in these positions, the user is less likely to extend his wrist into the positions while wearing the brace. On the other hand, if the brace is designed stiff so that extension and flexion are essentially not permitted, then these positions would not be reached during the swing. Either way, the golfer learns the proper feel of the golf swing while wearing the brace.

The rods 14, 16 of the present invention provide exercise for the fingers, hand, wrist, and forearm of the user and develop their strength while hitting golf balls. The rods 14, 16 are oriented so that the angle A is approximately 19°, placing the left hand in the proper position for swinging the club when the device 12 is on the hand of the user. The rods 14, 16 are held near the fingers by the glove stalls 32, 34. These stalls 32, 34 work to maintain the rods near the fingers when the fingers are closed or try to grip a club. Therefore, the resistance of the rods 14, 16 to bending causes the hand to work against the bending of the rods to grip a club. The tendency or bias of the rods to return to their original configuration causes the hand to be in an eccentric contraction when the golfer maintains the grip on the club. This eccentric contraction helps keep the muscles intact while allowing the user to realize the benefit of a light grip and frees the hands for smooth swinging action. The other fingers may also be provided with rods, but it has been found by the inventors that the use of the rods up only the middle and ring fingers of the hand allows adduction and abduction to occur with the least amount of hindrance.

When the brace 18 and the rods 14, 16 are used in conjunction, the user receives the maximum benefit. The brace 18 serves to resist flexions and extensions, while the rods 14, 16 exercise the hand. Further benefit may be derived by using the rods 14, 16 and the brace 18 in conjunction. Because the rods 14, 16 resist closing of the hand, the golfer must work against the resistance to bending of those rods 14, 16 to grip the club. Maintaining this grip causes the rods 14, 16 to work against the hands of the golfer in an eccentric contraction. As is known in biomechanics, contraction of a muscle group causes the corresponding opposite group of muscles to fire, or sends a response to the muscles to contract. Thus, it is believed that while these major flexor muscles are being contracted, the extensors are receiving a response which is telling them to contract. The firing on each side of the forearm causes a corresponding tightening in the forearm in response to the finger contractions and works both sides of the forearm. This tightening or exercising of the ann occurs without the player having to deadlock the grip so that the hands are able to perform adduction and abductions without difficulty. Also, the tightening occurs with a built-in resistance to movement of the wrists (the brace 18). Thus, the extensors and flexors are both exercised and strengthened without a corresponding incorrect position of the wrist occurring during the swing and while the grip is loose enough so that a proper swing may occur.

The inventors have found that after the device 12 is used for an extended period of time, the extensors and flexors are strengthened and tend to relax in the proper position. Therefore, even after the device 12 is removed, the hand tends to remain in the same orientation because the extensors and flexors have been trained and strengthened to hold the wrist in the proper position. In addition, during that time the wrist has been freed so that it may learn the proper movement of adduction and abductions during a swing.

Use of the brace 18 alone does not give the benefits of the present invention. Use of the brace alone probably would cause proper memory after hours and hours of practice, but that is a luxury which most amateurs do not have. Use of the rods 14, 16 causes the extensors and flexors to fire and develops strength for holding the wrist in position. Thus, benefit may be achieved over a much shorter period of time. The device 12, therefore, not only serves as a biofeedback reminder to hold the wrist in the proper position, but also develops the muscle to hold the club in that proper position after the device 12 has been removed. Because the rods 14, 16 are bent to the proper position (that is, 19°), a proper grip is easier to maintain on the club. Practice with the device 12 also promotes this proper angle of the wrist.

The brace 18 may be removable from the insert holder 20 by providing a slit 50 at the distal end of the insert holder 22. This allows the brace 18 to be removed from the device 12 so that the device 12 may be used without the brace 18, or different strength braces 18 may be inserted in the insert holder 20. In addition, the use of an extensible fabric for the wrist strap 24 lessens the effect of a strong brace 18.

To further strengthen the extensors or flexors of the forearm, the brace 18 may be preformed into a bent position. Such a brace 118 is shown in FIG. 6. Depending on the orientation of the brace 118, by inserting the brace into the insert holder 20, the device 12 is in a position that the hand is automatically biased to extension or flexion. In this manner, a golfer is required to work against the brace 118 to force the club into the proper position upon hitting. Thus, if the golfer maintains the club in the proper position, he exercises the flexors or extensors of the forearm. One must be careful not to use the brace 118 in this position for an extended period of time, however, because the brace 118 may promote bad habits in that it may force the wrist to relax in extension or flexion.

While this invention is described as used with a golf swing, it is to be understood that the invention can be used for tennis and other racket sports, as well as other club and bat sports. In addition, the device may ergonomically brace the wrists so that the device may exercise or rehabilitate a person with musculoskeletal disorders such as carpal tunnel syndrome. Use of the device 12 in sports outside of golf may require a different angle A.

While this invention has been described in detail with particular reference to preferred embodiments thereof, it will be understood the variations and modifications can be affected within the spirit and scope of the invention as described herein and before and as described in the appended claims.

What is claimed is:

1. A device for exercising and bracing the hand of a user, the device comprising:

a support shaped and configured to extend up at least two adjacent fingers;

flexible, inextensible, resilient rods having resistance to bending and operatively associated with the support and being configured to extend approximately from the tip of the fingers of the user to at least the base of the fingers;

means for maintaining the rods in operative association with the fingers of the user such that the resilience and resistance to bending of the rod cause the hand to be exercised when the user attempts to close the hand or to maintain the hand in a closed or partially closed position;

a brace operatively associated with the support, the brace configured to extend at least partly across the back of the hand of the user and at least partly across the back of the wrist of the user; and means for holding the brace firmly against the back of the hand and back of the wrist of the user such that extension or flexion of the wrist is resisted while permitting adduction and abduction, wherein said support is configured such that said rods extend at an acute angle from a line defined by the longitudinal axis of the forearm of the user, where the acute angle is ergonmically determined based on the use of the device.

2. The device of claim 1, wherein said angle is approximately 19°.

3. The device of claim 1, wherein said means for holding the brace comprises a wrist wrap attached to the brace which is configured to extend around the wrist of the user.

4. The device of claim 1, wherein one end of the rods extends between the brace and the hand of the user when the device is placed on the user.

5. The device of claim 1, wherein the one of the rods extends up one of the middle and ring fingers of the user.

6. The device of claim 1, and wherein one of the rods is configured to extend up the middle finger of the user and the other of the rods is configured to extend up the ring finger of the user.

7. The device of claim 1, wherein the device is configured to extend at least partially into a glove.

8. The device of claim 1, wherein the brace comprises a flexible, resilient material having a resistance to bending and is formed into a configuration so as to bias the hand of the user into extension or flexion.

9. The device of claim 1, wherein the brace comprises a flexible, resilient material having a resistance to bending.

10. The device of claim 1, wherein the brace comprises a substantially rigid material.

11. A device for exercising and bracing the hand of a user, the device comprising:

a glove having at least two adjacent finger stalls;

a support shaped and configured to extend up at least two finger stalls;

flexible, inextensible, resilient rods having resistance to bending operatively associated with the support and being journalled within the finger stalls and being configured to extend approximately from the tip of the fingers of the user to the base of the fingers;

a brace which extends at least partly into the glove which is configured to extend at least partly across the back of the hand of the user to at least partly across the back of the wrist of the user, the brace held in such a position by the glove that extension or flexion of the wrist is resisted while permitting adduction and abduction, wherein said support member is configured such that said rods extend at an acute angle from a line defined by the longitudinal axis of the forearm of the user, where the angle from a line defined by the longitudinal axis of the forearm of the user, where the acute angle is ergonomically determined based on the use of the device.

12. The glove of claim 11 wherein said angle is approximately 19°.

13. The glove of claim 11, further comprising a wrist wrap attached to the brace which is configured to extend around the wrist of the user.

14. The glove of claim 11, wherein one end of the rods extends behind the brace and between the brace and the hand of the user when the device is placed on the user.

15. The glove of claim 11, wherein one of said finger stalls is for receiving one of the middle and ring fingers of the user.

16. The glove of claim 11, further comprising a second rod and a second finger stall, and wherein the two finger stalls are for receiving the middle and ring finger of the user, and wherein one of the rods is configured to extend up the middle finger stall of the glove and the other of the rods is configured to extend up the ring finger stall of the glove.

17. The glove of claim 11, wherein the brace comprises a flexible, resilient material having a resistance to bending and is formed into a configuration so as to bias the hand of the user into extension or flexion.

18. The glove of claim 11, wherein the brace comprises a flexible, resilient material having a resistance to bending.

19. The glove of claim 11, wherein the brace comprises a substantially rigid material.

* * * * *